US012672704B1

(12) United States Patent
Cui et al.

(10) Patent No.: US 12,672,704 B1
(45) Date of Patent: Jul. 7, 2026

(54) ELECTRIC SUITCASE

(71) Applicant: SHENZHEN AOTOS TECHNOLOGY CO., LTD, Shenzhen (CN)

(72) Inventors: Yanhui Cui, Shenzhen (CN); Zhenxiang Huang, Shenzhen (CN)

(73) Assignee: SHENZHEN AOTOS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/087,366

(22) Filed: Mar. 21, 2025

(30) Foreign Application Priority Data

Feb. 25, 2025 (CN) ..... 202510212033.0

(51) Int. Cl.

| | |
|---|---|
| ***A45C 9/00*** | (2006.01) |
| ***A45C 5/03*** | (2006.01) |
| ***A45C 5/14*** | (2006.01) |
| ***A45C 13/26*** | (2006.01) |

(52) U.S. Cl.
CPC ..... *A45C 9/00* (2013.01); *A45C 5/03* (2013.01); *A45C 5/14* (2013.01); *A45C 13/262* (2013.01); *A45C 2009/005* (2013.01); *A45C 2013/267* (2013.01)

(58) Field of Classification Search
CPC ..... A45C 9/00; A45C 5/03; A45C 13/262; A45C 2009/005; A45C 2013/267
USPC ..... 190/1
See application file for complete search history.

(56) References Cited

U.S. PATENT DOCUMENTS 12,478,158 B1 * 11/2025 Wang ..... A45C 13/262
2016/0255928 A1 * 9/2016 O'Donnell ..... A45C 5/14

FOREIGN PATENT DOCUMENTS

JP H0582784 U * 11/1993

* cited by examiner

*Primary Examiner* — Don M Anderson
*Assistant Examiner* — Jessica Kavini Tamil
(74) *Attorney, Agent, or Firm* — HOWARD M COHN and Associates, LLC

(57) ABSTRACT

An electric suitcase includes a box body, a steering device, and pedal devices. The steering device includes a steering supporting base that is T-shaped. Handles are respectively disposed on left and right sides of the steering supporting base. First inclined portions each with an inclined surface facing downward are respectively disposed on left and right ends of the steering supporting base. Second inclined portions are respectively defined on the handles. The second inclined portions are one-to-one attached to the first inclined portions. The pedal devices include pedal fixing bases. A pedal body is plugged into each of the pedal fixing bases. Each pedal body is slidable with respect to a corresponding one of the pedal fixing bases. A pedal limiting mechanism is disposed on a bottom portion of each of the pedal fixing bases. A foot button is disposed on a top portion of each pedal body.

10 Claims, 18 Drawing Sheets

ELECTRIC SUITCASE

TECHNICAL FIELD

The present disclosure relates to a field of suitcases, and in particular to an electric suitcase.

BACKGROUND

While accommodating luggage, an electric suitcase is capable of driven by an electric wheel thereof to move, making it convenient for a user to push or ride. In order to control a direction of the electric wheel, conventional electric suitcases are equipped with a steering handle on a steering tube of the electric wheel. However, in actual applications, if the steering handle is small, it is not easy to control the direction of the electric wheel. If the steering handle is too large, the steering handle may exceed a width of the electric suitcases, which is not conducive to storing the steering handle. In addition, the conventional electric suitcases generally use a switch device on the steering handle to control start and stop of the electric wheel. While controlling the direction of the electric wheel via the steering handle, the user further needs to control the start and stop of the electric wheel via the steering handle. As a result, more hand control operations are required, which increases control difficulty and leads to a poor user experience.

SUMMARY

In view of the deficiencies in the prior art, a technical problem to be solved by the present disclosure is to provide an electric suitcase that is easy for steering control and walking control, and a handle thereof is convenient to fold and unfolded.

To solve the technical problem, the present disclosure provides the electric suitcase. The electric suitcase comprises a box body, two rear wheels disposed on a rear side of the box body, a steering tube assembly vertically disposed on a front side of the box body, an electric wheel disposed on a lower end of the steering tube assembly, a steering device disposed on an upper end of the steering tube assembly, and pedal devices respectively disposed on a left side and a right side of the box body.

The steering device comprises a steering supporting base. The steering supporting base is T-shaped. A lower end of the steering supporting base is fixedly connected to the upper end of the steering tube assembly. Handles are respectively disposed on a left side and a right sides of the steering supporting base. First inclined portions are respectively disposed on a left end and a right end of the steering supporting base. Each of the first inclined portions has an inclined surface facing downward. A mounting hole is defined in each of the first inclined portions. A bearing is embedded in each mounting hole.

Second inclined portions are respectively defined on the handles. The second inclined portions are one-to-one attached to the first inclined portions. Each of the handles comprises a rotating shaft. Each rotating shaft passes through a corresponding bearing. Each rotating shaft passes through a corresponding rotating shaft mounting hole. A limiting cap is disposed on one end of each rotating shaft. Each limiting cap is engaged with an inner wall of a corresponding mounting hole.

The pedal devices comprise pedal fixing bases. The pedal fixing bases are fixedly connected to the box body. A pedal body is plugged into each of the pedal fixing bases. Each pedal body is slidable with respect to a corresponding one of the pedal fixing bases. One end of each pedal body is protruded from the corresponding one of the pedal fixing bases. A pedal limiting mechanism is disposed on a bottom portion of each of the pedal fixing bases. Each pedal limiting mechanism is connected to a corresponding pedal body and is configured to limit a position of the corresponding pedal body when the corresponding pedal body is retracted into or stretched from the corresponding one of the pedal fixing bases. A foot button is disposed on a top portion of each pedal body.

A battery and a controller are disposed in the box body. Each foot button, the battery, and the electric wheel are electrically connected to the controller. Each foot button is configured to control the electric wheel to start and stop.

Optionally, each of the first inclined portions comprises an annular groove. Each mounting hole is defined in a center of a corresponding annular groove. Each of the second inclined portions comprises a protruding ring. Each protruding ring is concentric with a corresponding rotating shaft. Each protruding ring is disposed on an inner side of a corresponding annular groove and is rotatably matched with the corresponding annular groove.

An angle limiting plate is disposed at a bottom portion of each rotating shaft. A semicircular limiting groove is defined in each angle limiting plate. An angle limiting block is disposed on an edge of each mounting hole. Each angle limiting block is slidable in a corresponding semicircular limiting groove. A torsion spring is disposed in each annular groove. A first end of each torsion spring is connected to a corresponding one of the first inclined portions. A second end of each torsion spring is connected to a corresponding one of the second inclined portions.

Optionally, each of the handles comprises a handle body, a handle inner tube, and a handle limiting mechanism. A handle cavity is defined in each handle body. Each handle inner tube and each handle limiting mechanism are inserted into a corresponding handle cavity. Each of the second inclined portions is fixed to an upper end of a corresponding handle inner tube. Each of the second inclined portions covers an upper end opening of a corresponding handle cavity. Each handle limiting mechanism comprises a retractable spring bolt. Each retractable spring bolt passes through and is slidable in a spring bolt hole defined in a corresponding one of the second inclined portions. Each of the first inclined portions comprises two locking holes. Each retractable spring bolt is allowed to insert into any one of the two locking holes of a corresponding one of the first inclined portions. The two locking holes of each of the first inclined portions are symmetrically disposed on two sides of the annular groove.

Optionally, each handle limiting mechanism comprises a handle limiting base, a spring bolt sliding block and a pressing cap. Each handle limiting base is fixed in a corresponding handle cavity. A limiting sliding groove is defined in each handle limiting base. Each spring bolt sliding block is disposed in a corresponding limiting sliding groove. Each spring bolt sliding block is slidable with respect to the corresponding limiting sliding groove. An outer side surface of each pressing cap is flush with an outer surface of a corresponding handle body. Each pressing cap is movable with respect to the corresponding handle body. A wedge-shaped driving tongue is disposed on the inner side of each pressing cap. A driving tongue sleeve is disposed on one side of each handle limiting base facing a corresponding pressing cap. A wedge-shaped hole is defined in one side of each spring bolt sliding block. Each wedge-shaped hole is flush with a corresponding driving tongue sleeve. Each wedge-shaped driving tongue passes through a corresponding driving tongue sleeve and extends into a corresponding wedge-shaped hole. An outer inclined surface of each wedge-shaped driving tongue is in sliding fit with an inner inclined surface of a corresponding wedge-shaped hole. Each retractable spring bolt is disposed on a corresponding spring bolt sliding block. A spring bolt spring is disposed in each handle cavity. Each spring bolt spring is configured to drives a corresponding spring bolt sliding block and a corresponding retractable spring bolt to slide outward. When each pressing cap is pressed, each wedge-shaped driving tongue drives a corresponding spring bolt sliding block and a corresponding retractable spring bolt to retract into a corresponding handle cavity.

Optionally, a rotating shaft mounting hole is defined in a center of each of the second inclined portions. Each rotating shaft passes through the corresponding rotating shaft mounting hole and extends outward. A flange is disposed on an inner end of each rotating shaft. Each flange is fixedly connected to an inner side portion of a corresponding one of the second inclined portions.

Optionally, an upper cover is fixed on a top portion of the steering supporting base. Two push buttons are fixed within a space formed by the upper cover and the steering supporting base. A shifting lever of each of the push buttons extends outward from the steering supporting base.

Optionally, the steering tube assembly comprises a steering tube base and a steering tube. The electric wheel is disposed on a lower end of the steering tube base. The steering tube is inserted into an inner side of an upper end of the steering tube base. The steering tube is configured to drive the steering tube base to synchronously rotate. The steering supporting base is disposed on an upper end of the steering tube.

Optionally, each pedal limiting mechanism comprises a limiting pin fixed to a bottom portion of a corresponding one of the pedal fixing bases. A limiting hook bent inward toward a corresponding one of the pedal fixing bases is disposed on a first end of each limiting pin. A hook sliding groove is defined in a bottom portion of each pedal body. Each limiting hook is slidbly disposed in a corresponding hook sliding groove. When each pedal body slides outward from the corresponding one of the pedal fixing bases, each limiting hook hooks on a first end of the corresponding hook sliding groove.

Optionally, a limiting pin accommodating groove is defined in the bottom portion of each of the pedal fixing bases. Each limiting pin is disposed in a corresponding limiting pin accommodating groove. A sleeving ring is disposed on a second end of each limiting pin. The second end of each limiting pin is opposite to the first end thereof. A limiting pin fixing column is disposed in each limiting pin accommodating groove. Each sleeving ring is sleeved on a corresponding limiting pin fixing column. Each pedal limiting mechanism further comprises a limiting pin cover plate configured to cover on a corresponding limiting pin accommodating groove.

Optionally, two horizontal guide columns parallel to each other are disposed in each of the pedal fixing bases. The two horizontal guide columns of each of the pedal fixing bases are inserted into a corresponding pedal body and are slidbly connected to the corresponding pedal body. A pedal spring is sleeved on each of the horizontal guide columns. Each pedal spring is clamped between a corresponding pedal body and a corresponding one of the pedal fixing bases.

In the electric suitcase of the present disclosure, the box body has a function of accommodating articles. The steering tube assembly that is rotatable is disposed on the front side of the box body. By rotating the steering tube assembly to control the handles on the steering device, steering control of the electric wheel is achieved. The first inclined portions each with the inclined surface facing downward are respectively disposed on the left end and the right end of the steering supporting base, and correspondingly, the second inclined portions are respectively disposed on upper ends of the handles. An inclination angle of each of the first inclined portions is 45°. Since the second inclined portions are respectively attached to and rotated with the first inclined portions, the handles are able to be rotated to horizontal positions to be unfolded, and are also able to be rotated to vertical positions for folding and storage, which is convenient for a user to control steering, while saving space at the same time, making a structure of the steering device more compact. In addition, by arranging each pedal body in the corresponding one of the pedal fixing bases and arranging the foot button on each pedal body, it is not only convenient for the user to step on, but also convenient for the user to control moving of the electric wheel. Therefore, the electric suitcase is controlled by both hands and feet and provides a better user experience.

DETAILED DESCRIPTION

Figure 1:
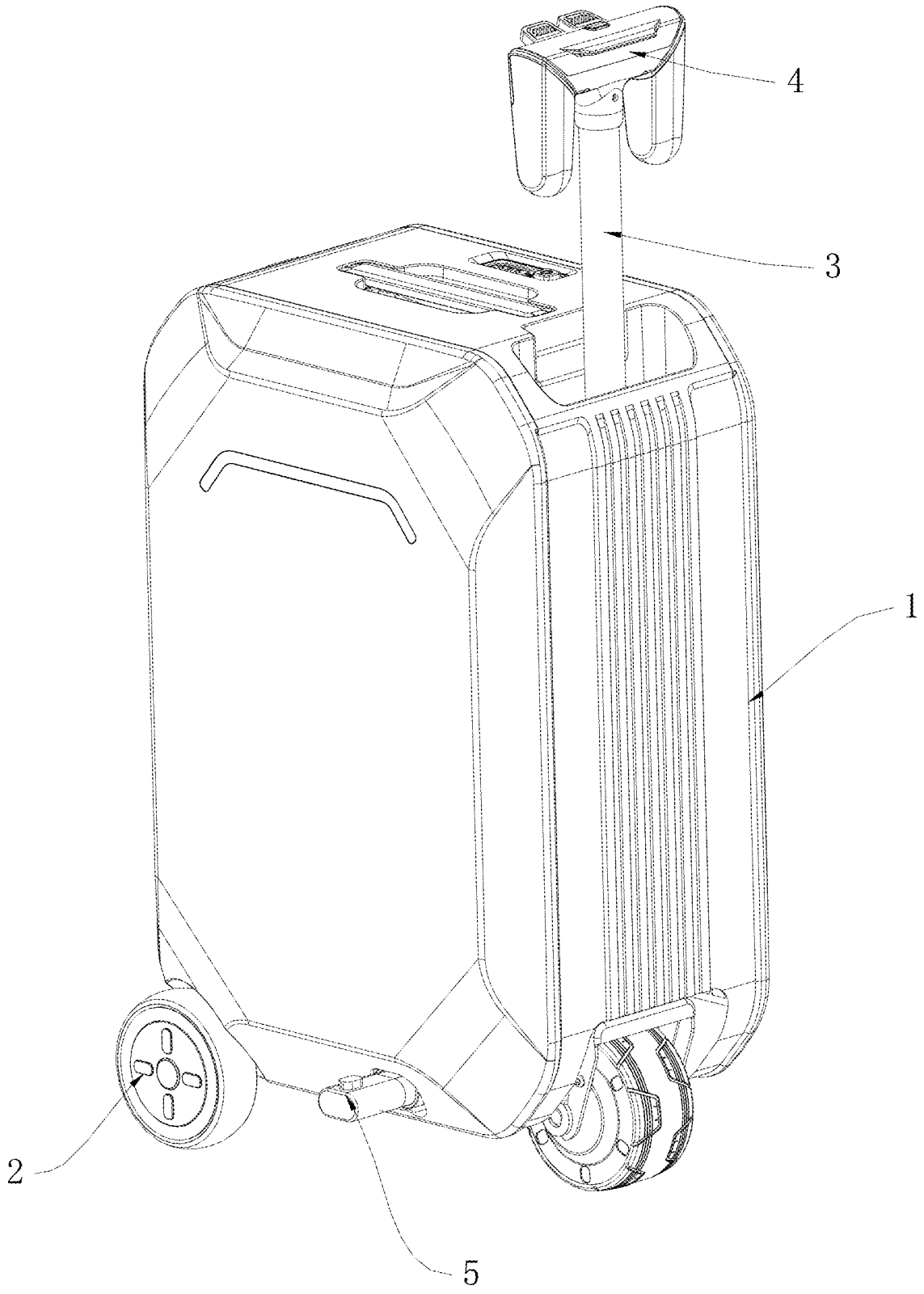
FIG. 1 is a perspective schematic diagram of an electric suitcase according to one embodiment of the present disclosure.

The present disclosure is described in more detail below with reference to the accompanying drawings and embodiments.

The present disclosure provides an electric suitcase. As shown in FIGS. 1-11, the electric suitcase comprises a box body 11, two rear wheels 2 disposed on a rear side of the box body 11, a steering tube assembly 3 vertically disposed on a front side of the box body 11, an electric wheel 30 disposed on a lower end of the steering tube assembly 3, a steering device 4 disposed on an upper end of the steering tube assembly 3, and pedal devices 5 respectively disposed on a left side and a right side of the box body 11.

The steering device 4 comprises a steering supporting base 40. The steering supporting base 40 is T-shaped. A lower end of the steering supporting base 40 is fixedly connected to the upper end of the steering tube assembly 3. Handles 41 are respectively disposed on a left side and a right sides of the steering supporting base 40. First inclined portions 42 are respectively disposed on a left end and a right end of the steering supporting base 40. Each of the first inclined portions 42 has an inclined surface facing downward. A mounting hole 420 is defined in each of the first inclined portions 42. A bearing 43 is embedded in each mounting hole 420.

Second inclined portions 410 are respectively defined on the handles 41. The second inclined portions 410 are one-to-one attached to the first inclined portions 42. Each of the handles 41 comprises a rotating shaft 411. Each rotating shaft 411 passes through a corresponding bearing 43. Each rotating shaft 411 passes through a corresponding rotating shaft mounting hole. A limiting cap is disposed on one end of each rotating shaft 411. Each limiting cap is engaged with an inner wall of a corresponding mounting hole 420.

The pedal devices 5 comprise pedal fixing bases 50. The pedal fixing bases 50 are fixedly connected to the box body 11. A pedal body 51 is plugged into each of the pedal fixing bases 50. Each pedal body 51 is slidable with respect to a corresponding one of the pedal fixing bases 50. One end of each pedal body 51 is protruded from the corresponding one of the pedal fixing bases 50. A pedal limiting mechanism 52 is disposed on a bottom portion of each of the pedal fixing bases 50. Each pedal limiting mechanism 52 is connected to a corresponding pedal body 51 and is configured to limit a position of the corresponding pedal body 51 when the corresponding pedal body 51 is retracted into or stretched from the corresponding one of the pedal fixing bases 50. A foot button 53 is disposed on a top portion of each pedal body 51.

A battery and a controller 54 are disposed in the box body 11. Each foot button 53, the battery, and the electric wheel 30 are electrically connected to the controller 54. Each foot button 53 is configured to control the electric wheel 30 to start and stop.

In the electric suitcase of the present disclosure, the box body 11 has a function of accommodating articles. The steering tube assembly 3 that is rotatable is disposed on the front side of the box body 11. By rotating the steering tube assembly 3 to control the handles 41 on the steering device 4, steering control of the electric wheel 30 is achieved. The first inclined portions 42 each with the inclined surface facing downward are respectively disposed on the left end and the right end of the steering supporting base 40, and correspondingly, the second inclined portions 410 are respectively disposed on upper ends of the handles 41. An inclination angle of each of the first inclined portions 42 is 45°. Since the second inclined portions 410 are respectively attached to and rotated with the first inclined portions 42, the handles 41 are able to be rotated to horizontal positions to be unfolded, and are also able to be rotated to vertical positions for folding and storage, which is convenient for a user to control steering, while saving space at the same time, making a structure of the steering device 4 more compact. In addition, by arranging each pedal body 51 in the corresponding one of the pedal fixing bases 50 and arranging the foot button 53 on each pedal body 51, it is not only convenient for the user to step on, but also convenient for the user to control moving of the electric wheel 30. Therefore, the electric suitcase is controlled by both hands and feet and provides a better user experience.

In order to achieve good rotational cooperation between the steering supporting base 40 and the handles 41, in the embodiment, as shown in FIGS. 3-6, each of the first inclined portions 42 comprises an annular groove 421. Each mounting hole 420 is defined in a center of a corresponding annular groove 421. Each of the second inclined portions 410 comprises a protruding ring 412. Each protruding ring 412 is concentric with a corresponding rotating shaft 411. Each protruding ring 412 is disposed on an inner side of a corresponding annular groove 421 and is rotatably matched with the corresponding annular groove 421. An angle limiting plate 413 is disposed at a bottom portion of each rotating shaft 411. A semicircular limiting groove 414 is defined in each angle limiting plate 413. An angle limiting block 422 is disposed on an edge of each mounting hole 420. Each angle limiting block 422 is slidable in a corresponding semicircular limiting groove 414. A torsion spring 44 is disposed in each annular groove 421. A first end of each torsion spring 44 is connected to a corresponding one of the first inclined portions 42. A second end of each torsion spring 44 is connected to a corresponding one of the second inclined portions 410.

In the embodiment, each angle limiting block 422 is matched with the corresponding semicircular limiting groove 414 to limit a rotation angle of each of the handles, so that the handles 41 are able to rotate within an angle range of 180°, thereby realizing horizontal unfold and vertical storage of the handles.

Figure 6:
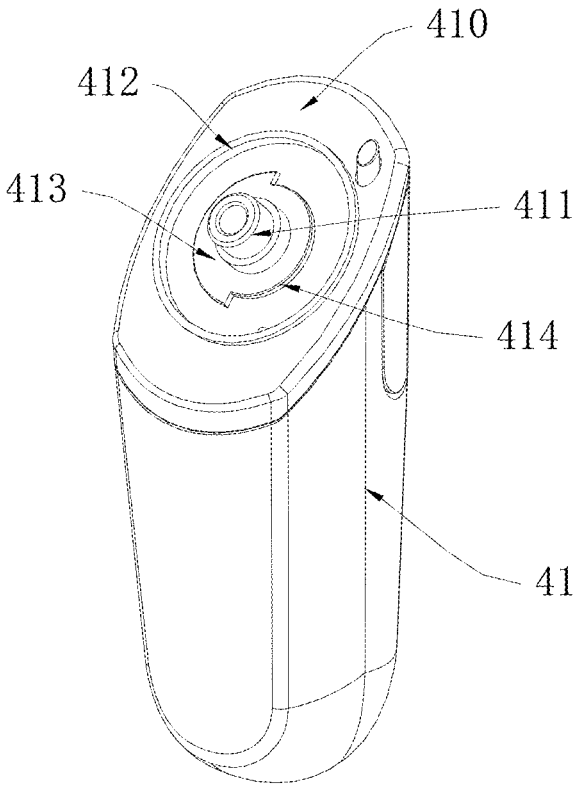
FIG. 6 is a perspective schematic diagram of a handle according to one embodiment of the present disclosure.
Figure 7:
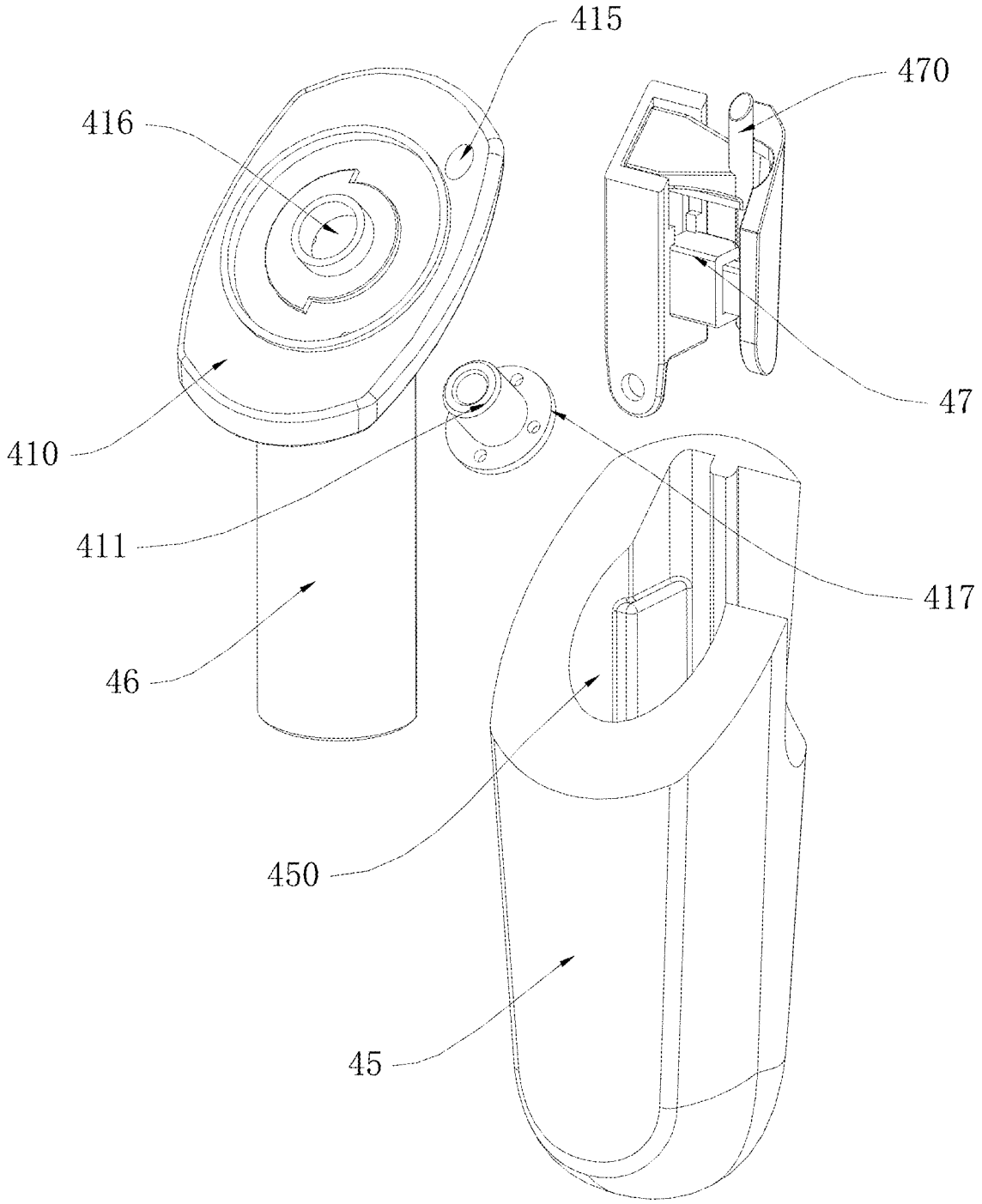
FIG. 7 is an exploded schematic diagram of the handle according to one embodiment of the present disclosure.
Figure 8:
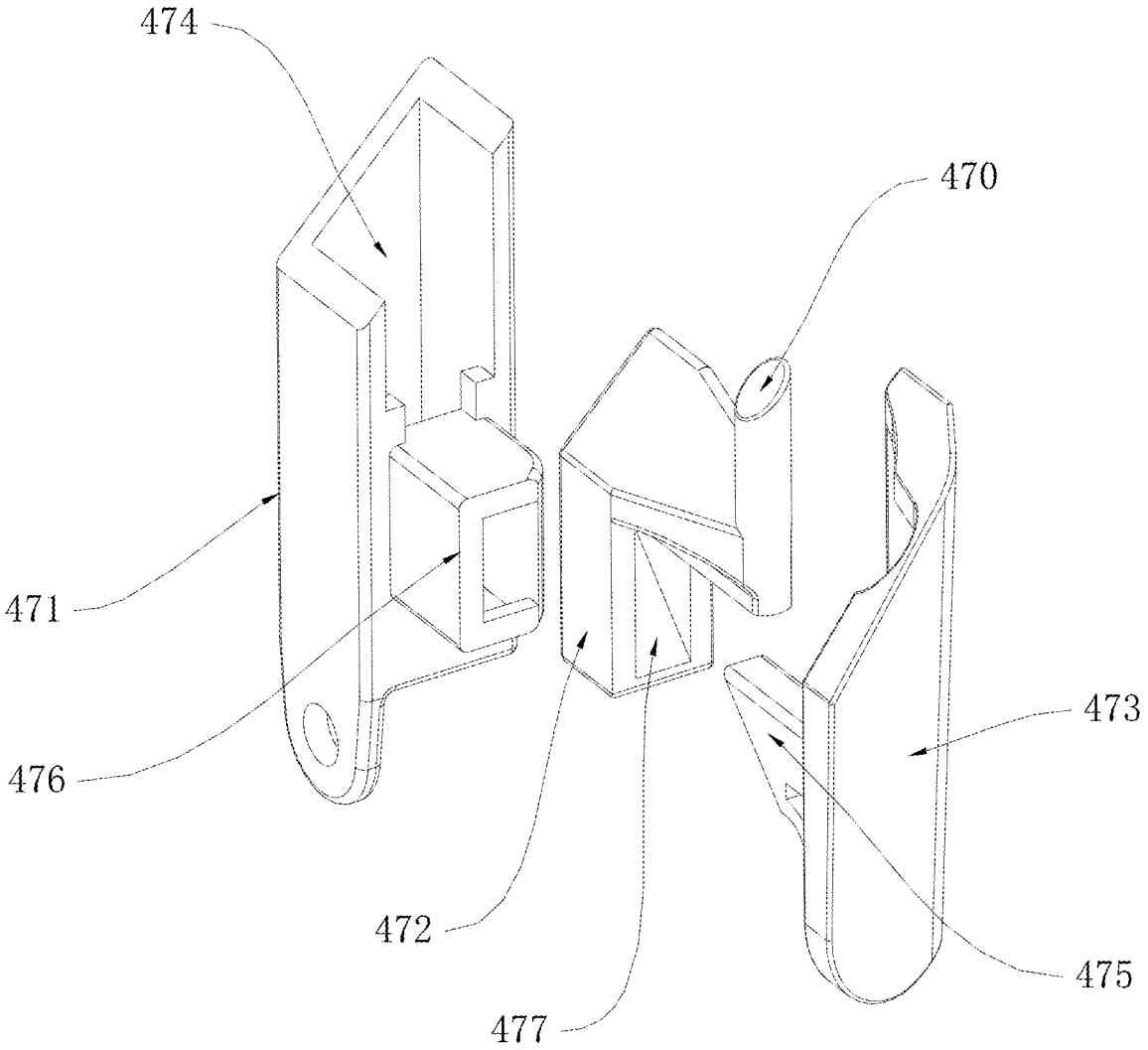
FIG. 8 is an exploded schematic diagram of a handle limiting mechanism according to one embodiment of the present disclosure.

In one optional structure of each of the handles 41, as shown in FIGS. 6-8, each of the handles 41 comprises a handle body 45, a handle inner tube 46, and a handle limiting mechanism 47. A handle cavity 450 is defined in each handle body 45. Each handle inner tube 46 and each handle limiting mechanism 47 are inserted into a corresponding handle cavity 450. Each of the second inclined portions 410 is fixed to an upper end of a corresponding handle inner tube 46. Each of the second inclined portions 410 covers an upper end opening of a corresponding handle cavity 450. Each handle limiting mechanism 47 comprises a retractable spring bolt 470. Each retractable spring bolt 470 passes through and is slidable in a spring bolt hole 415 defined in a corresponding one of the second inclined portions 410. Each of the first inclined portions 42 comprises two locking holes 423. Each retractable spring bolt 470 is allowed to insert into any one of the two locking holes 423 of a corresponding one of the first inclined portions 42. The two locking holes 423 of each of the first inclined portions 42 are symmetrically disposed on two sides of the annular groove 421.

Furthermore, each handle limiting mechanism 47 comprises a handle limiting base 471, a spring bolt sliding block 472, and a pressing cap 473. Each handle limiting base 471 is fixed in a corresponding handle cavity 450. A limiting sliding groove 474 is defined in each handle limiting base 471. Each spring bolt sliding block 472 is disposed in a corresponding limiting sliding groove 474. Each spring bolt sliding block 472 is slidably disposed in the corresponding limiting sliding groove 474. An outer side surface of each pressing cap 473 is flush with an outer surface of a corresponding handle body 45. Each pressing cap 473 is movable with respect to the corresponding handle body 45. A wedge-shaped driving tongue 475 is disposed on the inner side of each pressing cap 473. A driving tongue sleeve 476 is disposed on one side of each handle limiting base 471 facing a corresponding pressing cap 473. A wedge-shaped hole 477 is defined in one side of each spring bolt sliding block 472. Each wedge-shaped hole 477 is flush with a corresponding driving tongue sleeve 476. Each wedge-shaped driving tongue 475 passes through a corresponding driving tongue sleeve 476 and extends into a corresponding wedge-shaped hole 477. An outer inclined surface of each wedge-shaped driving tongue 475 is slidable on an inner inclined surface of a corresponding wedge-shaped hole 477. Each retractable spring bolt 470 is disposed on a corresponding spring bolt sliding block 472. A spring bolt spring is disposed in each handle cavity 450. Each spring bolt spring is configured to drives a corresponding spring bolt sliding block 472 and a corresponding retractable spring bolt to slide outward. When each pressing cap 473 is pressed, each wedge-shaped driving tongue 475 drives a corresponding spring bolt sliding block 472 and a corresponding retractable spring bolt 470 to retract into a corresponding handle cavity 450.

In the embodiment, when each pressing cap 473 is pressed, the corresponding wedge-shaped driving tongue 475 moves into the corresponding driving tongue sleeve 476. When the outer inclined surface of each wedge-shaped driving tongue 475 contacts and slides with respect to the inner inclined surface of the corresponding wedge-shaped hole 477, each wedge-shaped driving tongue 475 drives the corresponding spring bolt sliding block 472 to move into the corresponding handle cavity 450, thereby driving the corresponding retractable spring bolt 470 to retract. At this time, each of the handles 41 is unlocked, and the user is allowed to rotate the handles 41 to adjust angles and positions of the handles 41.

In order to stably mounting and fixing the rotating shaft 411 of each of the handles 41, in the embodiment, a rotating shaft mounting hole 416 is defined in a center of each of the second inclined portions. Each rotating shaft 411 passes through the corresponding rotating shaft mounting hole 416 and extends outward. A flange 417 is disposed on an inner end of each rotating shaft 411. Each flange 417 is fixedly connected to an inner side portion of a corresponding one of the second inclined portions 410.

Optionally, an upper cover 400 is fixed on atop portion of the steering supporting base 40. Two push buttons 401 are fixed within a space formed by the upper cover 400 and the steering supporting base 40. A shifting lever 402 of each of the push buttons 401 extends outward from the steering supporting base 40. The push buttons 401 are configured to control acceleration, deceleration, forward movement, reverse movement, etc. of the electric wheel.

Optionally, the steering tube assembly 3 is a retractable steering tube. Specifically, the steering tube assembly 3 comprises a steering tube base 31 and a steering tube 32. The electric wheel 30 is disposed on a lower end of the steering tube base 31. The steering tube 32 is inserted into an inner side of an upper end of the steering tube base 31. The steering tube is configured to drive the steering tube base 31 to synchronously rotate. The steering supporting base 40 is disposed on an upper end of the steering tube 32. Specifically, the steering tube 32 is movable up and down with respect to the steering tube base 31.

Figure 9:
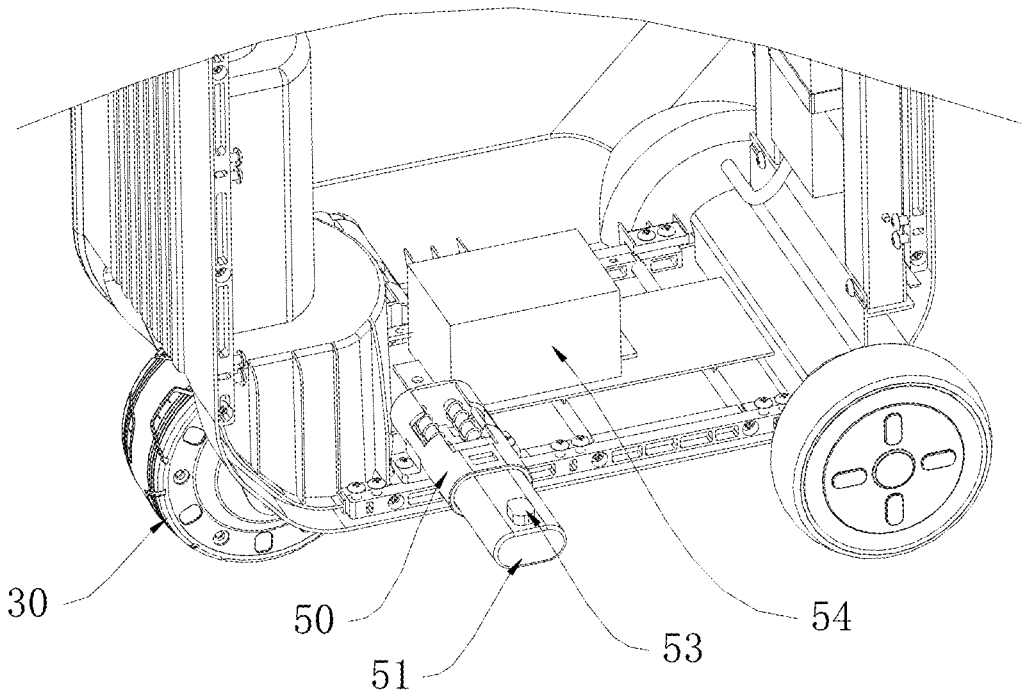
FIG. 9 is a structural schematic diagram of pedal devices according to one embodiment of the present disclosure.
Figure 10:
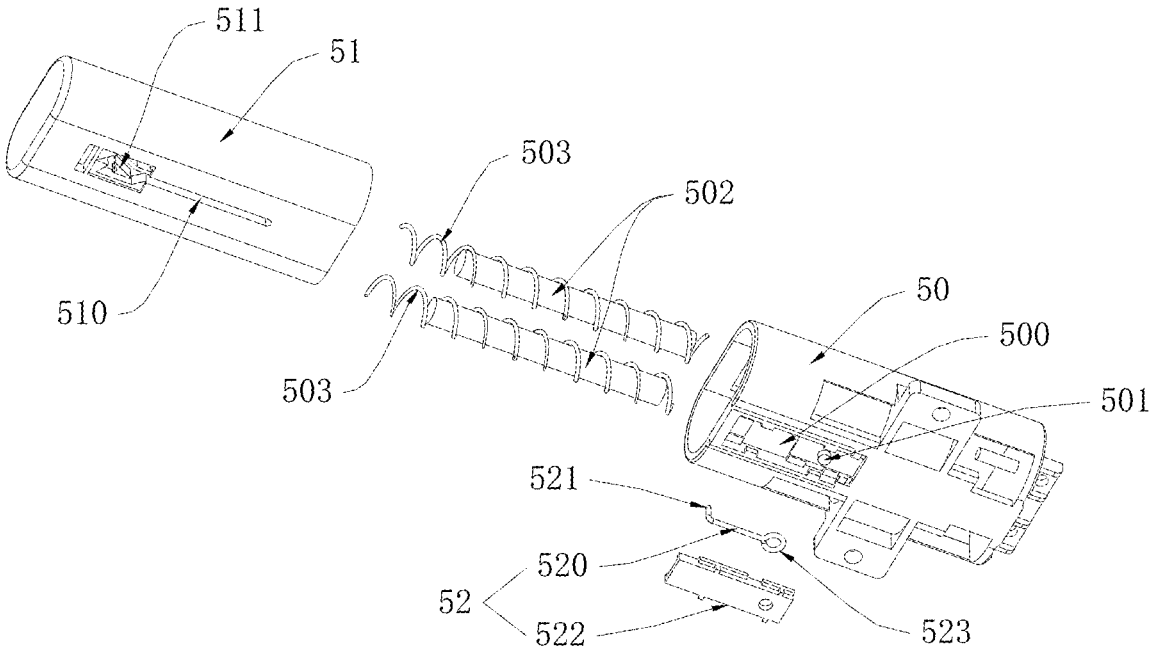
FIG. 10 is an exploded schematic diagram of the pedal devices according to one embodiment of the present disclosure.
Figure 11:
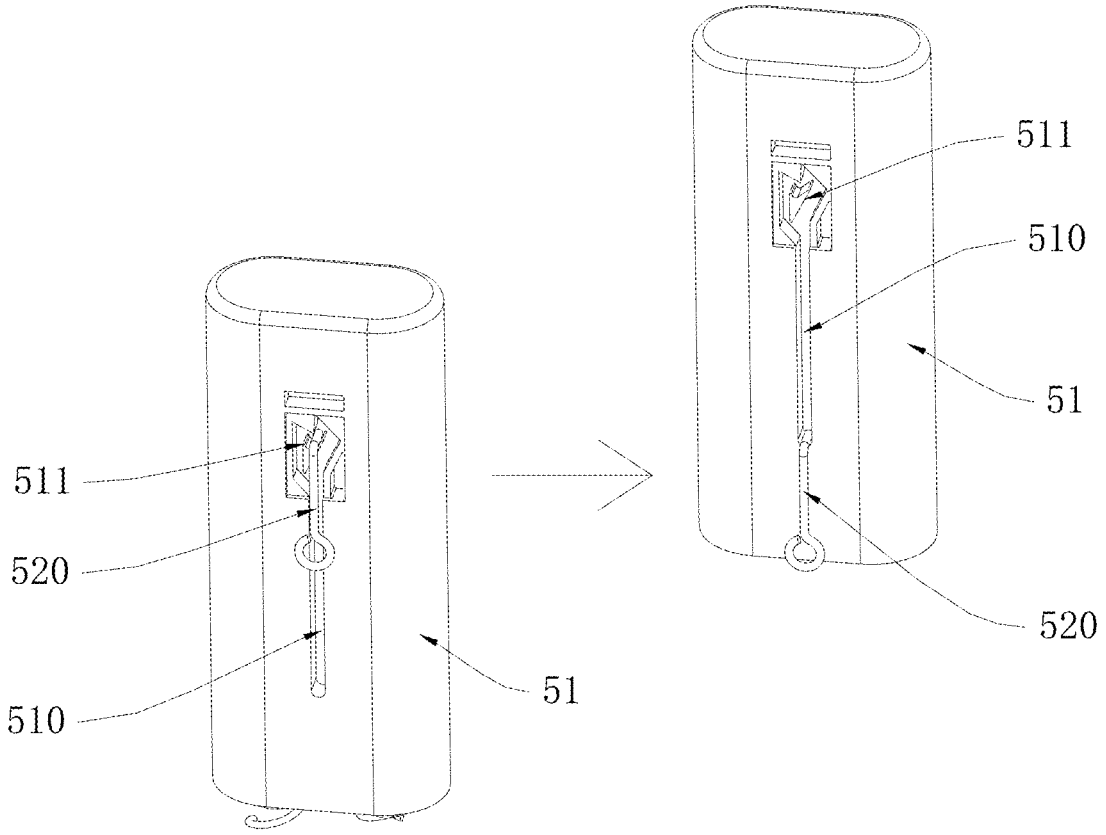
FIG. 11 is a schematic diagram showing mounting relationship between each pedal body and each limiting pin according to one embodiment of the present disclosure.
Figure 12:
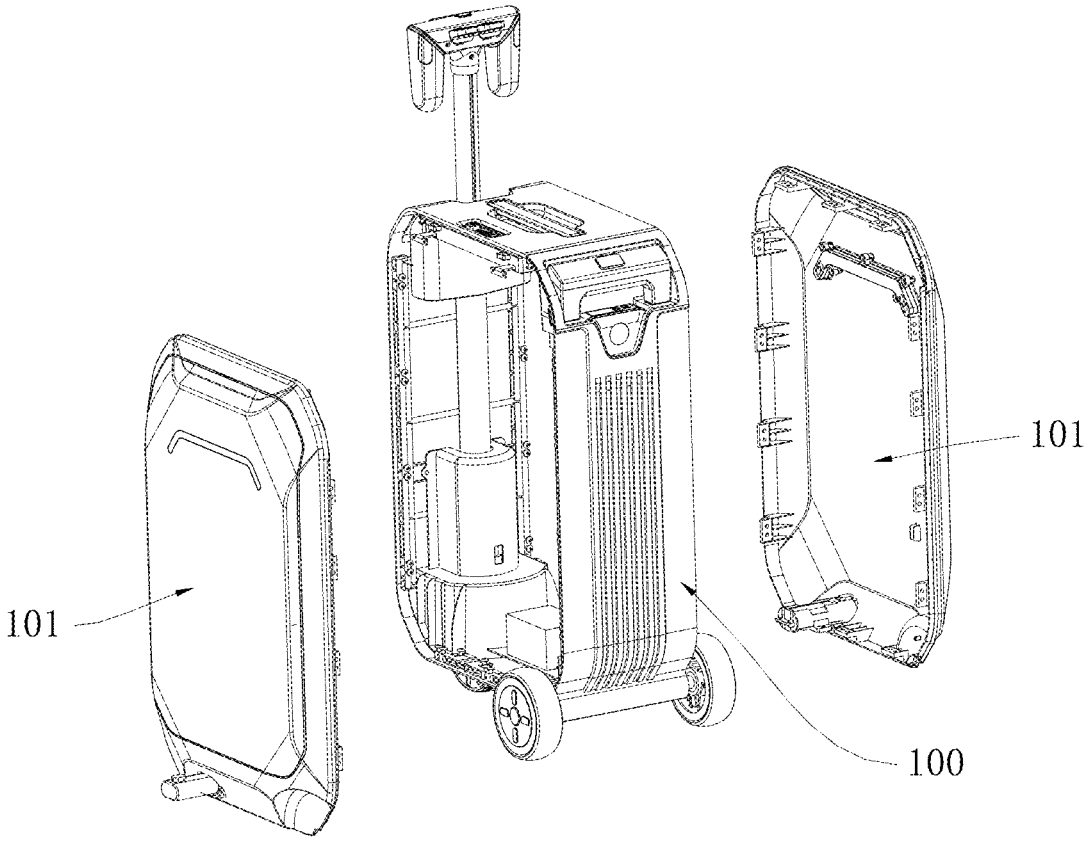
FIG. 12 is an exploded schematic diagram of a box body according to one embodiment of the present disclosure.
Figure 13:
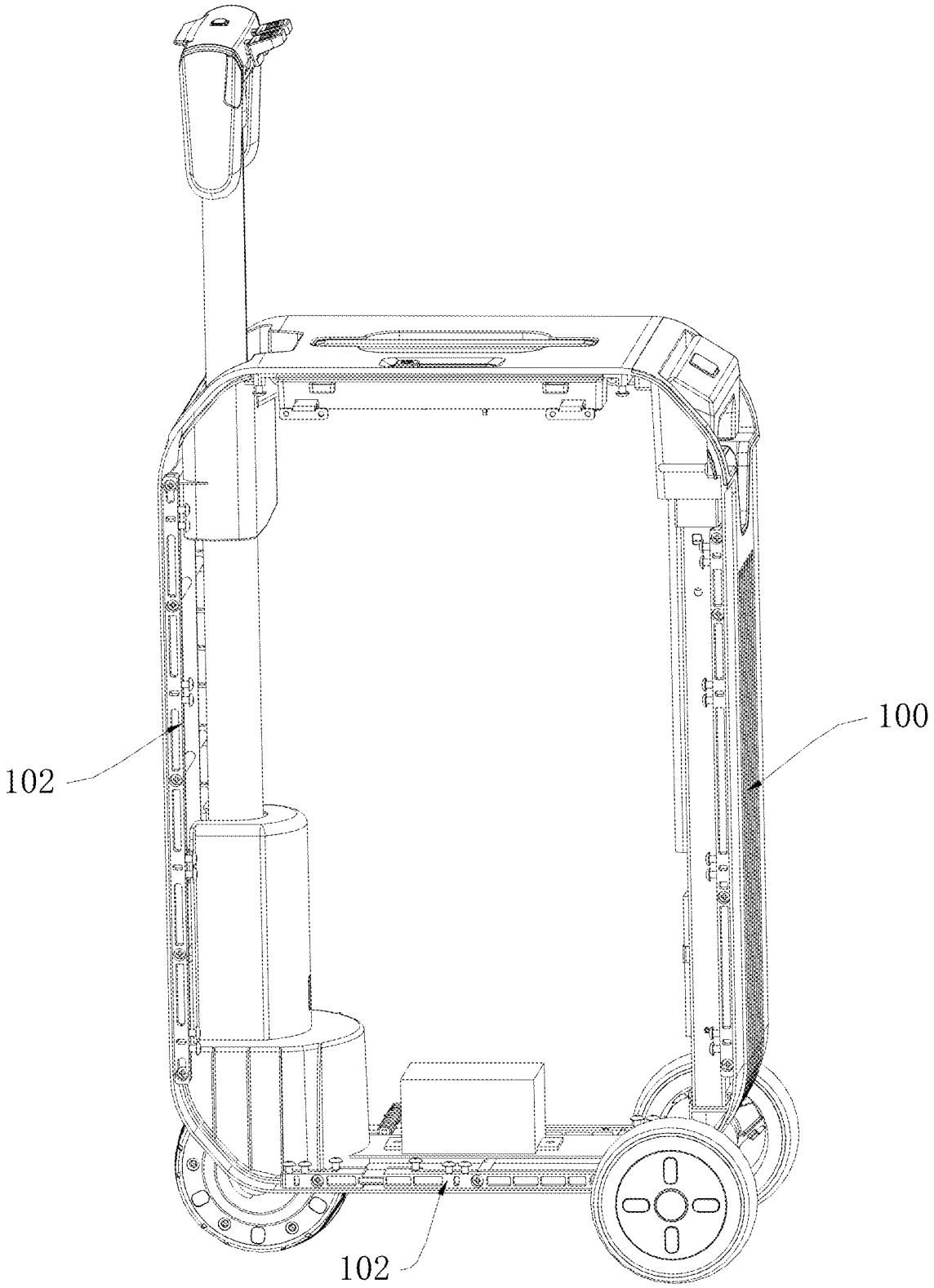
FIG. 13 is a schematic diagram of an enclosure frame and a hardware rack according to one embodiment of the present disclosure.
Figure 14:
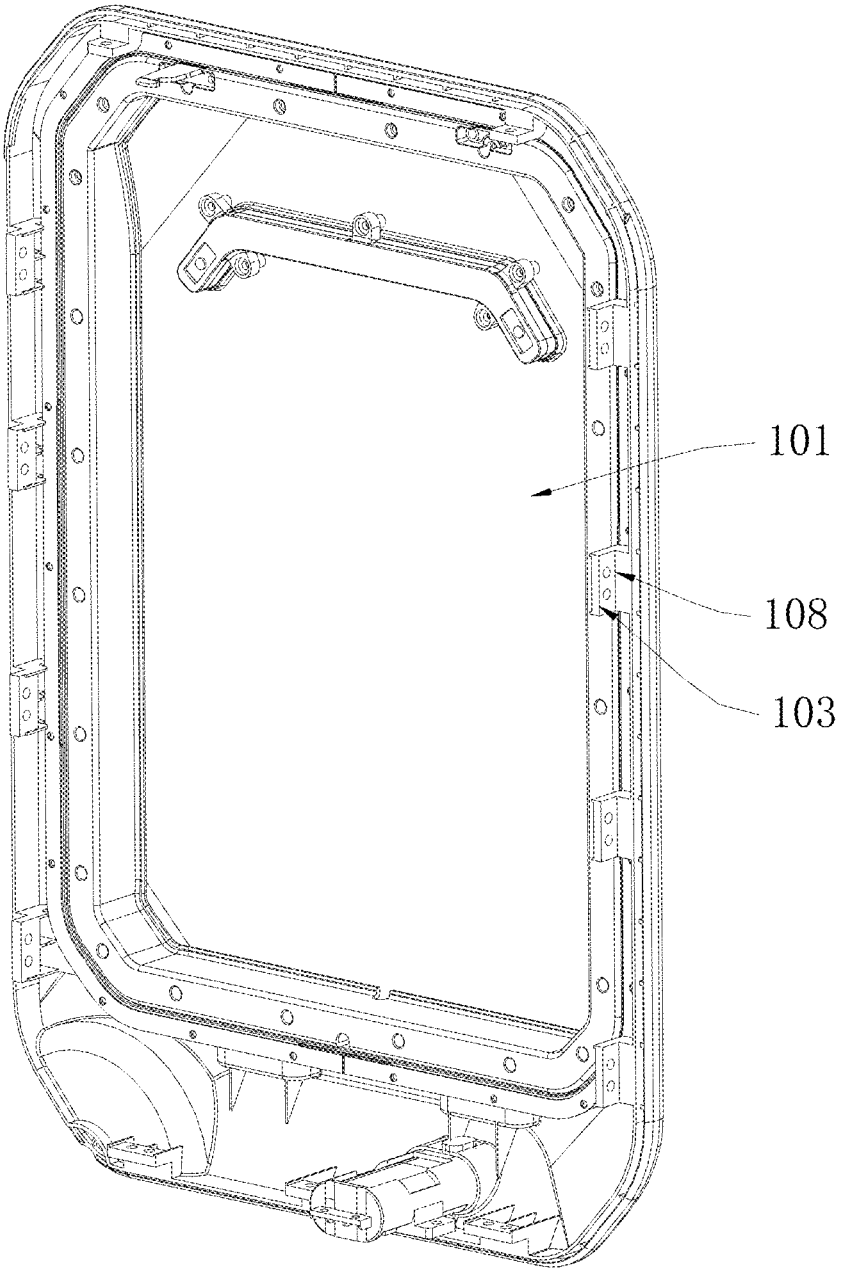
FIG. 14 is a structural schematic diagram of a side plate according to one embodiment of the present disclosure.
Figure 15:
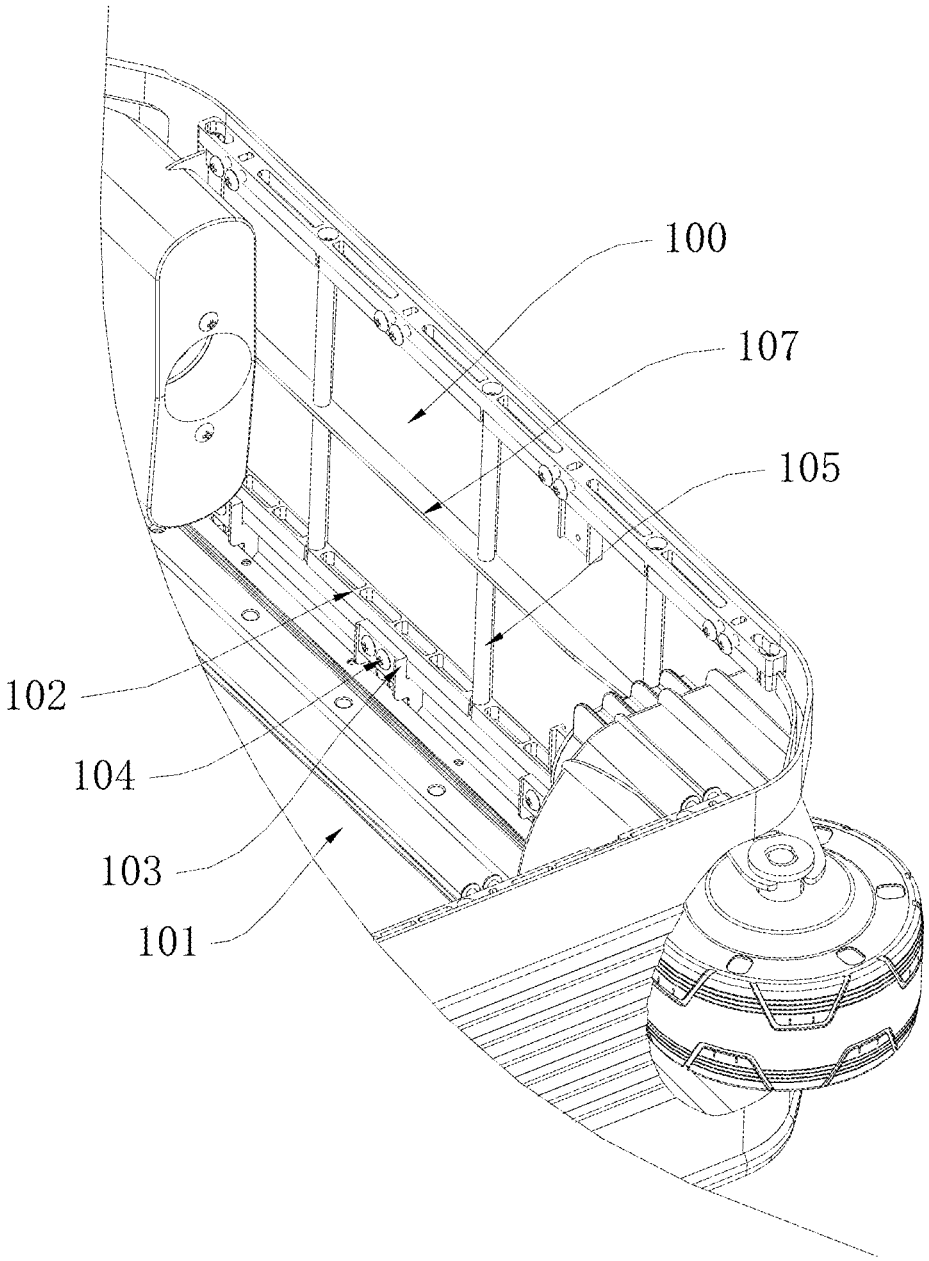
FIG. 15 is a structural schematic diagram of the enclosure frame, a hardware rack and a side plate that are assembled together.
Figure 16:
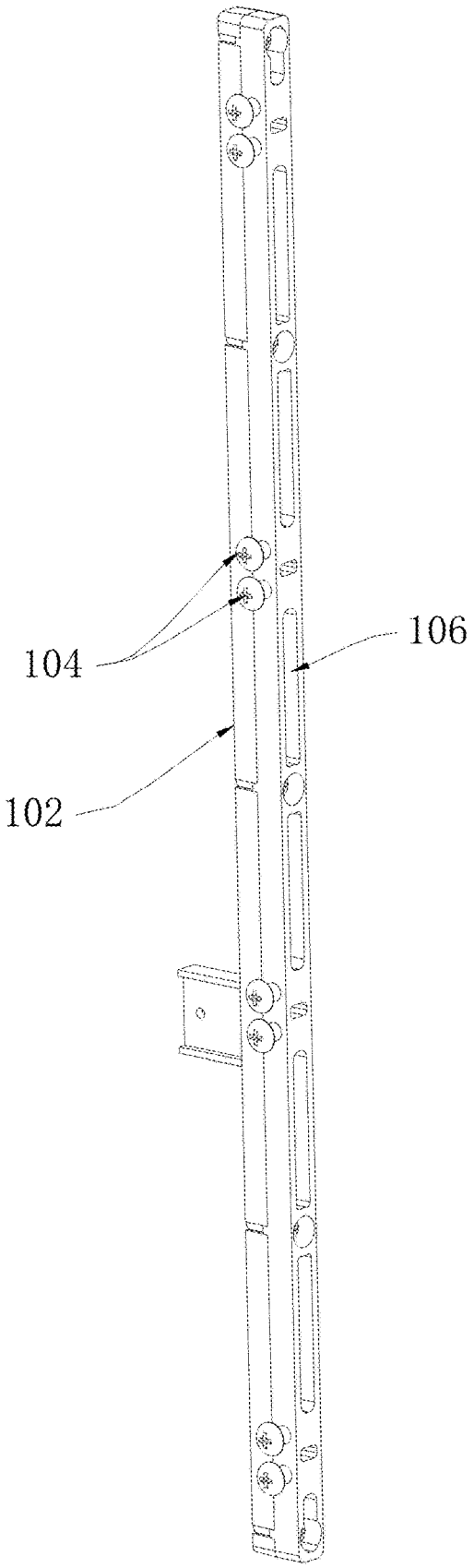
FIG. 16 is a perspective schematic diagram of the hardware rack according to one embodiment of the present disclosure.

Furthermore, as shown in FIGS. 9-11, each pedal limiting mechanism 52 comprises a limiting pin 520 fixed to a bottom portion of a corresponding one of the pedal fixing bases 50. A limiting hook 521 bent inward toward a corresponding one of the pedal fixing bases 50 is disposed on a first end of each limiting pin 520. A hook sliding groove 510 is defined in a bottom portion of each pedal body 51. Each limiting hook 521 is slidbly disposed in a corresponding hook sliding groove 510. When each pedal body 51 slides outward from the corresponding one of the pedal fixing bases 50, each limiting hook 521 hooks on a first end of the corresponding hook sliding groove 510. Specifically, each limiting pin 520 slides on and is matched with the corresponding hook sliding groove 510 to limit an extending length of the corresponding pedal body 51 with respect to the corresponding one of the pedal fixing bases 50.

On this basis, when each pedal body 51 retracts inwardly, in order to lock each pedal body 51 in a corresponding retracted position, in the embodiment, a self-locking mechanism 511 is disposed on a second end of each hook sliding groove 510. Each self-locking mechanism 511 is configured to lock or unlock the corresponding limiting hook 521. A positional relationship between each pedal body 51 and the corresponding limiting pin 520 in the retracted state and the extended state is shown in FIG. 11.

In order to hide and fix each limiting pin 520, a limiting pin accommodating groove 500 is defined in the bottom portion of each of the pedal fixing bases 50. Each limiting pin 520 is disposed in a corresponding limiting pin accommodating groove 500. A sleeving ring 523 is disposed on a second end of each limiting pin 520. The second end of each limiting pin 520 is opposite to the first end thereof. A limiting pin fixing column 501 is disposed in each limiting pin accommodating groove 500. Each sleeving ring 523 is sleeved on a corresponding limiting pin fixing column 501. Each pedal limiting mechanism 52 further comprises a limiting pin cover plate 522 configured to cover on a corresponding limiting pin accommodating groove 500.

In actual use, when each pedal body 51 is unlocked, each pedal body 51 extends out under an action of elastic force. in order to realize an automatic pop-up function, in the embodiment, two horizontal guide columns 502 parallel to each other are disposed in each of the pedal fixing bases 50. The two horizontal guide columns 502 of each of the pedal fixing bases 50 are inserted into a corresponding pedal body 51 and are slidbly connected to the corresponding pedal body 51. A pedal spring 503 is sleeved on each of the horizontal guide columns 502. Each pedal spring 503 is clamped between a corresponding pedal body 51 and a corresponding one of the pedal fixing bases 50.

The present disclosure further provides the box body 1 of the electric suitcase. As shown in FIGS. 12-16, the box body comprises s enclosure frame 100 and two side cover plates 101. The two side cover plates 101 are symmetrically covered on two sides of the enclosure frame 100, and hardware racks 102 are disposed on four edges of the two sides of the enclosure frame 100. The hardware racks 102 are long strips. A first side surface of each of the hardware racks 102 contacts an inner wall of the enclosure frame 100, and the hardware racks 102 are fixedly connected to the enclosure frame 100. Fixing portions 103 bent toward the enclosure frame 100 are disposed on inner sides of the two side cover plates 101. Each of the fixing portions 103 contacts a second side surface of a corresponding one of the hardware racks 102. The fixing portions 103 and the hardware racks 102 are fixedly connected by fixing screws 104.

In the embodiment, the enclosure frame 100 serves as a core support structure of the box body, and the hardware racks 102 are respectively disposed on the four edges of the two sides thereof in width and height directions. Two perpendicular sides of each of the hardware racks 102 are respectively fixedly connected to a corresponding one of the side cover plates 101 and the enclosure frame 100. Moreover, a connection relationship between the hardware racks 102, the enclosure frame 100, and the two side cover plates 101 enables the enclosure frame 100 to be more reliably and tightly fixed to the two side cover plates 101. Further, with the support of the hardware racks 102, a structural strength of the enclosure frame 100 and the two side cover plates 101 after assembly is effectively improved, so that the user is allowed to sit on the electric suitcase and control the electric suitcase to move.

In one optional embodiment, zippers or coded locks are respectively disposed on the two side cover plates, which are convenient for the user to take and put items. In the embodiment, a first side and a second side of each of the hardware racks 102 are disposed opposite to each other. The first side of each of the hardware racks 102 is a flat surface, which is configured to fit tightly with the inner wall of the enclosure frame 100.

In orde4r to fix the hardware racks 102 and the enclosure frame 100, in the embodiment, fixing columns 105 are disposed on the inner wall of the enclosure frame 100, and the fixing columns 105 extend along the width direction of the enclosure frame 100. The hardware racks 102 are fixedly connected to ends of the fixing columns 105 by mounting screws.

In one optional embodiment, each of the hardware racks 102 comprises strip-shaped openings 106. The hardware racks 102 are hollow to reduce internal stress and avoid deforming.

In order to further enhance a mechanical strength of the enclosure frame 100, in the embodiment, reinforcing rib 107 are disposed on the inner wall of the enclosure frame 100. The reinforcing rib 107 are perpendicular to the fixing columns 105. The fixing columns 105 and the reinforcing ribs 107 are integrally formed with the enclosure frame 100. The fixing columns 105 and the reinforcing ribs 107 enhance a stress strength of the enclosure frame 100.

In the embodiment, each of the fixing portions 103 is bent in a Z shape and defines an outer step notch 108. Each of the hardware racks 102 is clamped in a corresponding outer step notch 108. Each outer step notch 108 bent in the Z shape is configured to limit and fix a corresponding one of the hardware racks 102, which improves connection reliability between the hardware racks 102 and the two side cover plates 101.

Figure 2:
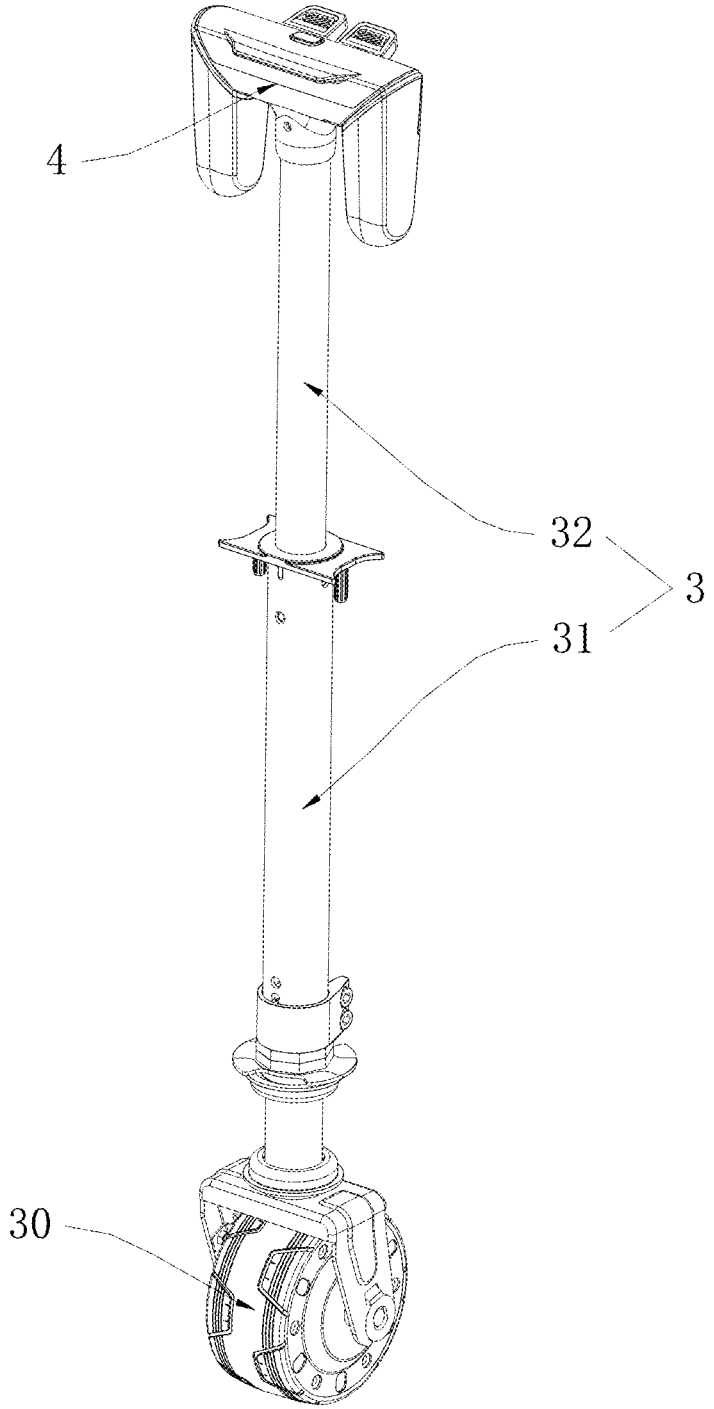
FIG. 2 is a structural schematic diagram of a steering tube assembly, a steering device, and an electric wheel according to one embodiment of the present disclosure.
Figure 3:
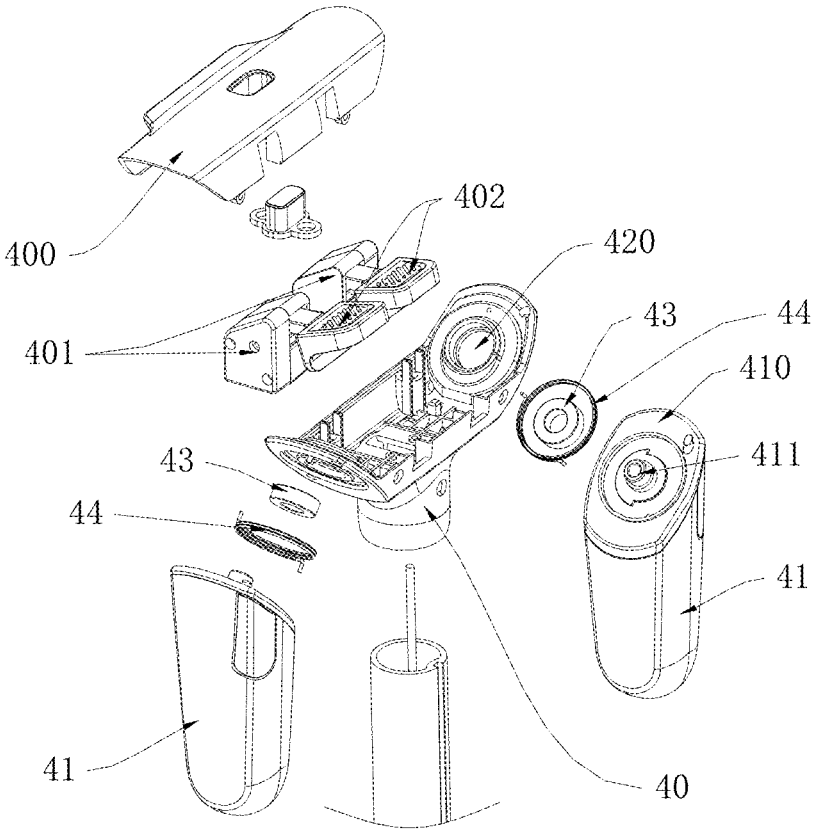
FIG. 3 is an exploded schematic diagram of the steering device according to one embodiment of the present disclosure.
Figure 4:
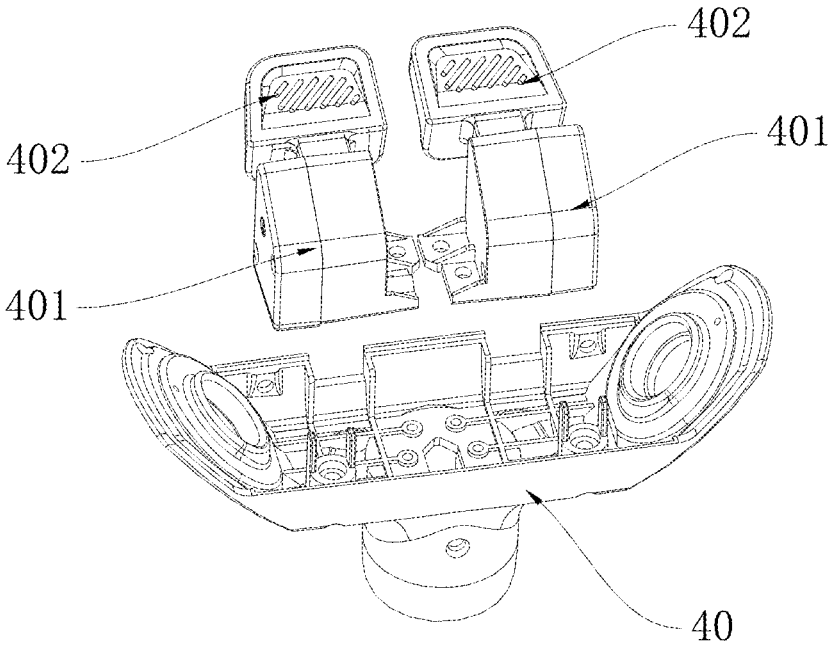
FIG. 4 is a structural schematic diagram of a steering supporting base and push buttons according to one embodiment of the present disclosure.
Figure 5:
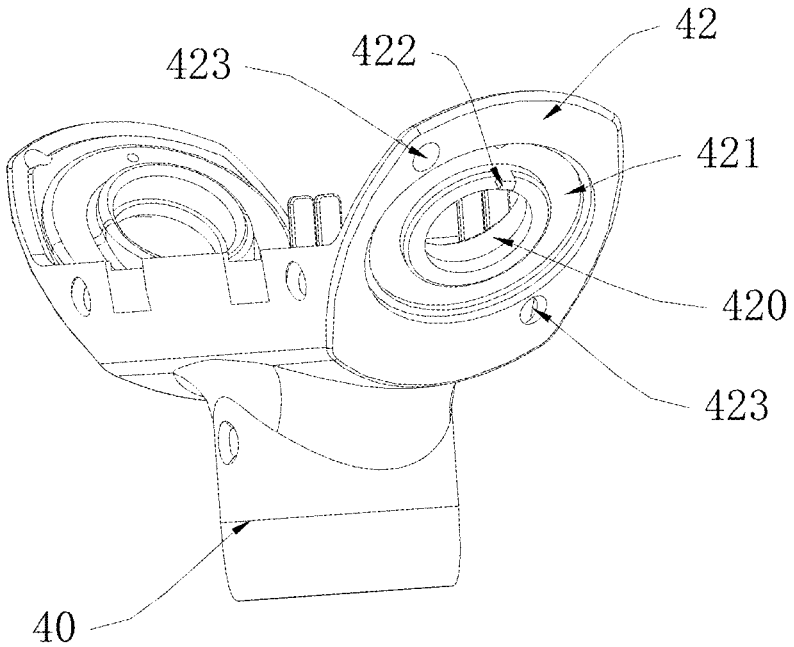
FIG. 5 is a perspective schematic diagram of the steering supporting base according to one embodiment of the present disclosure.
Figure 17:
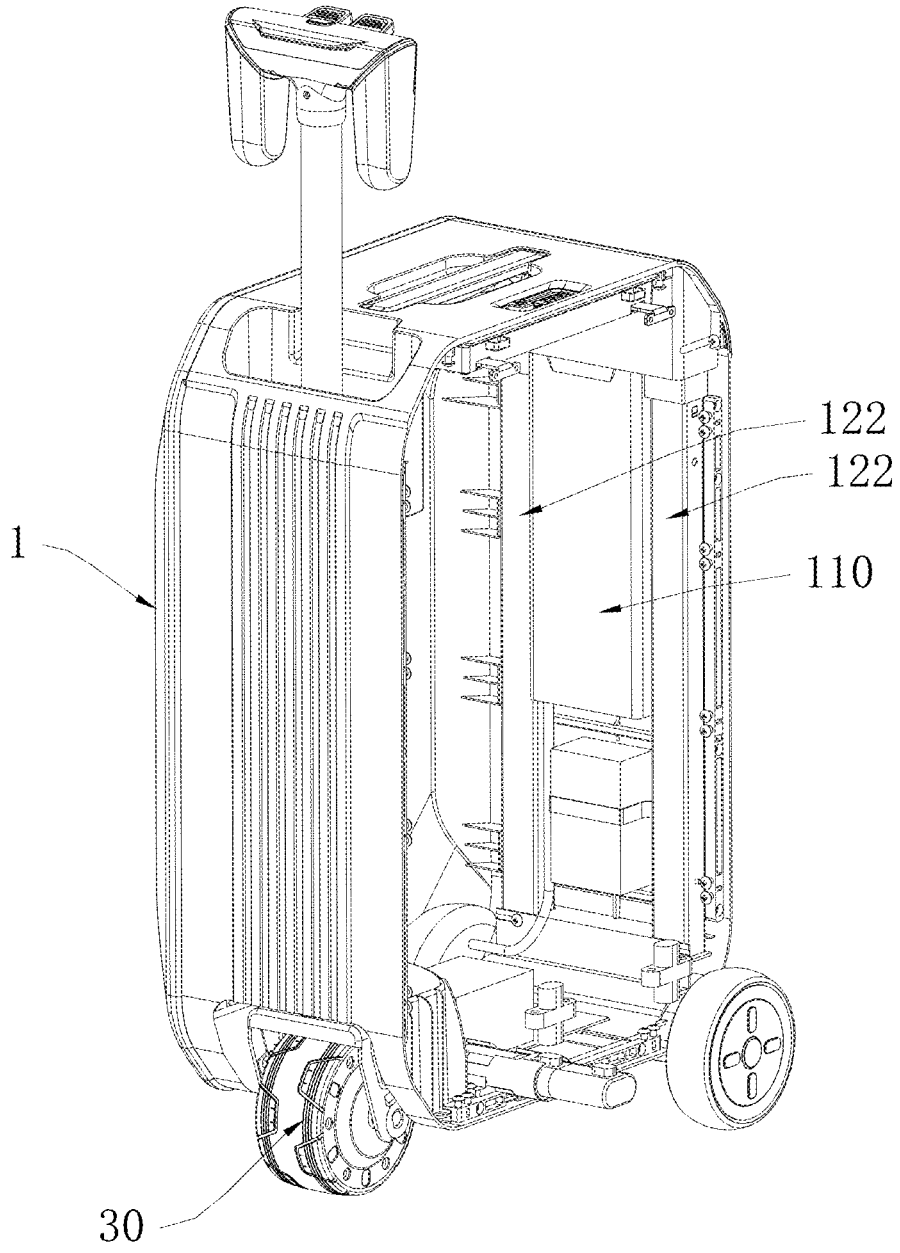
FIG. 17 is a schematic diagram of an internal structure of the box body according to one embodiment of the present disclosure.
Figure 18:
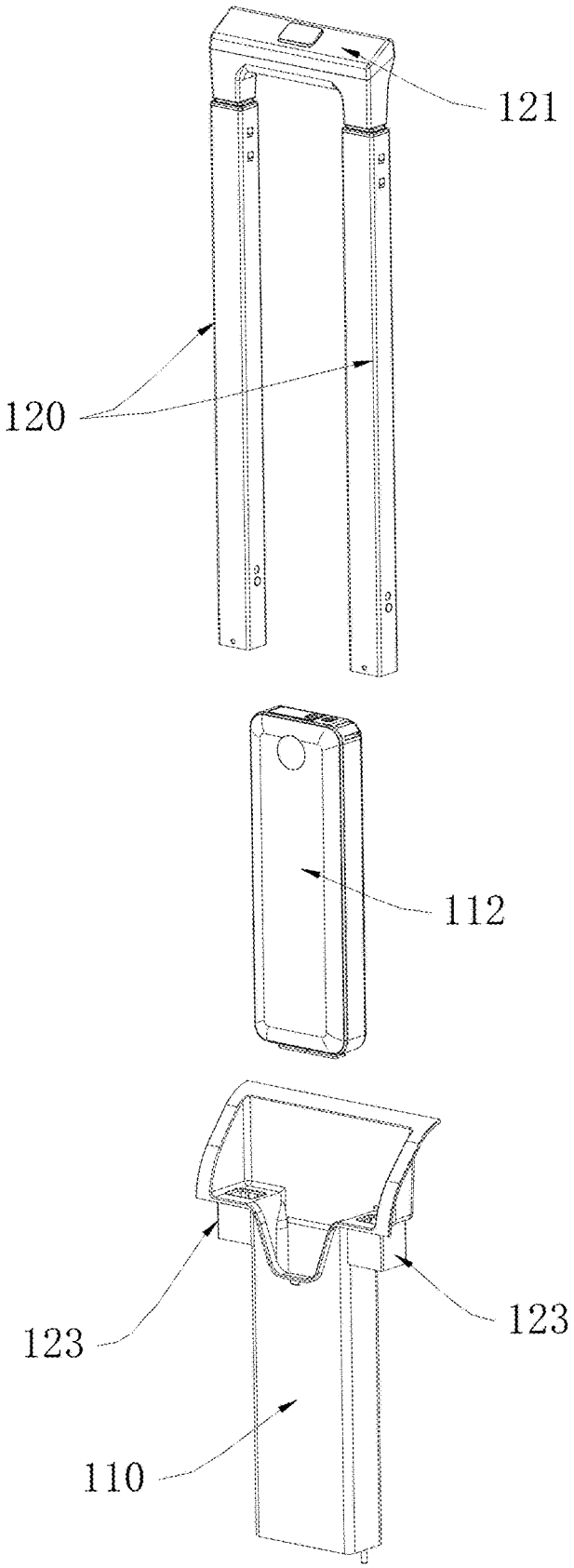
FIG. 18 is a schematic diagram of a battery box, a battery, and a pull rod according to one embodiment of the present disclosure.
Figure 19:
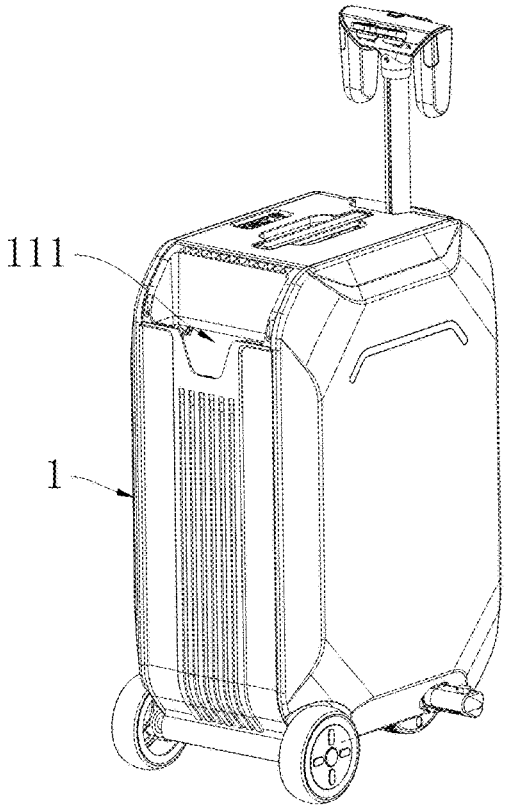
FIG. 19 is a schematic diagram of a battery fixing opening according to one embodiment of the present disclosure.
Figure 20:
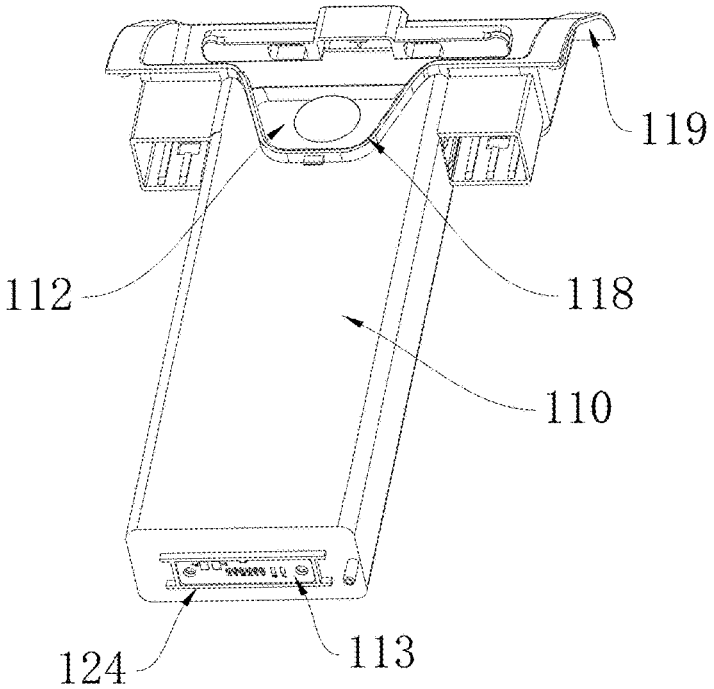
FIG. 20 is a perspective schematic diagram of the battery box according to one embodiment of the present disclosure.
Figure 21:
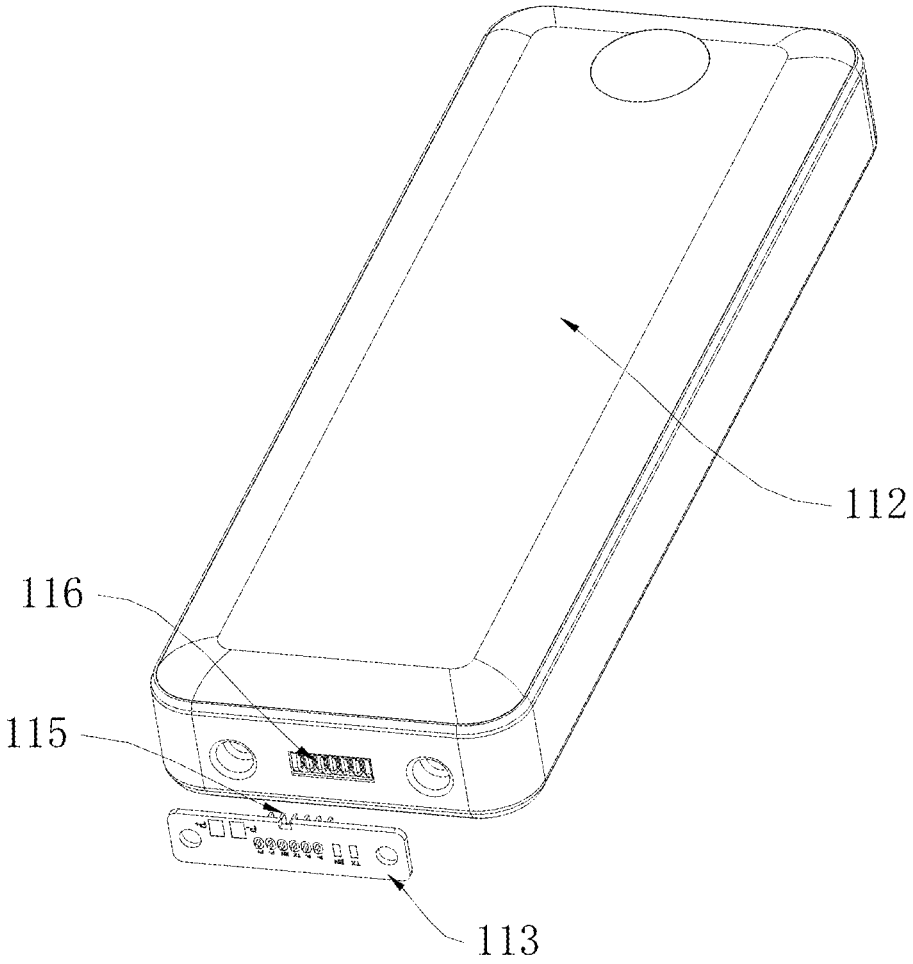
FIG. 21 is a schematic diagram of the battery and a connecting plate according to one embodiment of the present disclosure.
Figure 22:
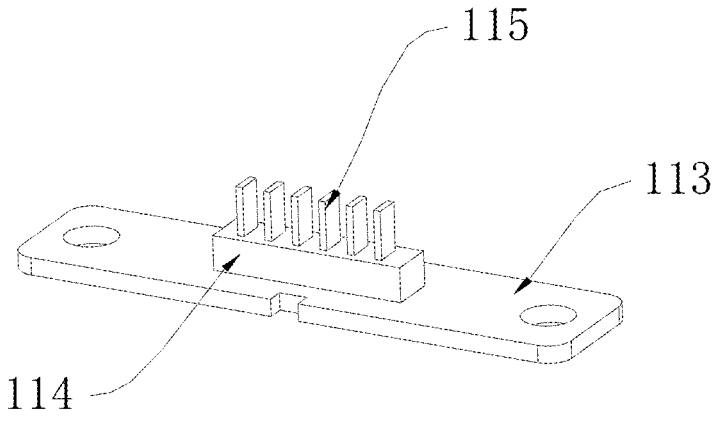
FIG. 22 is a perspective schematic diagram of the connecting plate according to one embodiment of the present disclosure.

The present disclosure further discloses a detachable battery mechanism of the electric suitcase. As shown in FIGS. 17-2, the detachable battery mechanism comprises the box body 1. A battery box 110 is fixed to the rear side of the box body 1. A battery box fixing opening 111 is defined in a top portion of the box body 1. The battery box 110 is disposed in the battery box fixing opening 111. An upper edge of the battery box 110 is snapped on the battery box fixing opening 111. A battery 112 is vertically inserted in the battery box 110, and the battery 112 is configured to power the electric wheel 30 of the electric suitcase. A connecting plate 113 is fixed to a bottom portion of the battery box 110. A terminal seat 114 is disposed on the connecting plate 113. The terminal seat 114 passes through the bottom portion of the battery box 110 and extends upward. Sheet terminals 115 are disposed on the terminal seat 114. Terminal sockets 116 are disposed on a bottom portion of the battery 112. The sheet terminals 115 are one-to-one corresponding to the terminal sockets 116. The sheet terminals 115 are respectively plugged into and tightly matched with the terminal sockets 116.

A battery box fixing opening 111 is defined in the top portion of the rear side of the box body 1. An upper edge of the battery box 110 is snap-fitted with an edge of the battery box fixing opening 111, and a connection between the two is tight and reliable. The battery 112 is vertically inserted into the battery box 110. The sheet terminals 115 on the terminal seat 114 are electrically connected to the terminal sockets 116 at the bottom portion of the battery 112, so that the battery 112 is able to power the electric wheel 30 of the electric suitcase. Compared with the prior art, the present disclosure facilitates disassembly and replacement of the battery 112, and at the same time enables the user to charge the battery 112 separately. In addition, the battery box 110 of the present disclosure is embedded in the rear side of the box body 1, and the battery box 110 does not protrude and be exposed. Therefore, the space is used reasonably and the battery is prevented from bumping and collision.

An outer edge of the battery box 110 defines a positioning notch 118, and one side of the battery 112 is aligned with an inner side of the positioning notch 118. The positioning notch 118 is defined on an edge of the battery box 110, so that the user is able to conveniently take out and install the battery 112 in the battery box 110.

In order to further improve waterproof and dustproof performance between the battery box 110 and the battery box fixing opening 111, in the embodiment, a brim 119 bent outward is disposed on an opening edge of the battery box 110. The brim 119 is tightly matched with the opening edge of the battery box fixing opening 111.

On this basis, two pull rods 120 that are vertically disposed are insertable into the rear side of the box body 1. The two pull rods 120 are slidably matched with a pull rod sleeve 122 disposed on an inner side of the box body 1. Upper ends of the two pull rods 120 are fixedly connected to a handle 121, and the two pull rods 120 are respectively disposed on two sides of the battery box 110. The handle 121 is disposed above the battery 112. In the embodiment, the battery box 110 is disposed between the two pull rods 120.

The handle 121 is disposed above the battery 112. When the handle 121 and the two pull rods 120 are pressed downward and retracted, the handle 121 and the two pull rods 120 are shield and protect the battery 112. In addition, this embodiment makes full use of the space between the two pull rods 120 and does not occupy additional space in the box body, so a structure of the electric suitcase is compact and the space is more reasonably used.

In order to further limit a position of the battery box 110 and make the two pull rods 120 slide well with respect to the battery box 110, in the embodiment, joint sleeves 123 are respectively disposed on two sides of the battery box 110. The joint sleeves 123 are one-to-one corresponding to the pull rod sleeves 122. The joint sleeves 123 are respectively connected to upper ends of the pull rod sleeves 122, and the two pull rods 120 respectively pass through the two joint sleeves 123.

In order to ensure that the sheet terminals 115 are one-to-one aligned and well plugged with the terminal sockets 116, and in order to limit a position of the connecting plate 113, a limiting frame 124 is disposed on the bottom portion of the battery box 110, and the connecting plate 113 is clamped in the limiting frame 124.

The above are only optional embodiments of the present disclosure and are not used to limit the present disclosure. Any modifications, equivalent replacements or improvements made within the technical scope of the present disclosure should be included in the protection scope of the present disclosure.

What is claimed is:

1. An electric suitcase, comprising:

a box body;

two rear wheels disposed on a rear side of the box body;

a steering tube assembly vertically disposed on a front side of the box body;

an electric wheel disposed on a lower end of the steering tube assembly;

a steering device disposed on an upper end of the steering tube assembly; and pedal devices respectively disposed on a left side and a right side of the box body;

wherein the steering device comprises a steering supporting base, the steering supporting base is T-shaped, a lower end of the steering supporting base is fixedly connected to the upper end of the steering tube assembly, handles are respectively disposed on a left side and a right sides of the steering supporting base, first inclined portions are respectively disposed on a left end and a right end of the steering supporting base, each of the first inclined portions has an inclined surface facing downward, a mounting hole is defined in each of the first inclined portions, and a bearing is embedded in each mounting hole;

wherein second inclined portions are respectively defined on the handles, the second inclined portions are one-to-one attached to the first inclined portions, each of the handles comprises a rotating shaft, each rotating shaft passes through a corresponding bearing, a limiting cap is disposed on one end of each rotating shaft, each limiting cap is engaged with an inner wall of a corresponding mounting hole;

wherein the pedal devices comprise pedal fixing bases, the pedal fixing bases are fixedly connected to the box body, a pedal body is plugged into each of the pedal fixing bases, each pedal body is slidable with respect to a corresponding one of the pedal fixing bases, one end of each pedal body is protruded from the corresponding one of the pedal fixing bases, a pedal limiting mechanism is disposed on a bottom portion of each of the pedal fixing bases, each pedal limiting mechanism is connected to a corresponding pedal body and is configured to limit a position of the corresponding pedal body when the corresponding pedal body is retracted into or stretched from the corresponding one of the pedal fixing bases, and a foot button is disposed on a top portion of each pedal body;

wherein a battery and a controller are disposed in the box body, each foot button, the battery, and the electric wheel are electrically connected to the controller, and the foot button is configured to control the electric wheel to start and stop.

2. The electric suitcase according to claim 1, wherein each of the first inclined portions comprises an annular groove, each mounting hole is defined in a center of a corresponding annular groove, each of the second inclined portions comprises a protruding ring, each protruding ring is concentric with a corresponding rotating shaft, and each protruding ring is disposed on an inner side of a corresponding annular groove and is rotatably matched with the corresponding annular groove;

wherein an angle limiting plate is disposed at a bottom portion of each rotating shaft, a semicircular limiting groove is defined in each angle limiting plate, an angle limiting block is disposed on an edge of each mounting hole, each angle limiting block is slidable in a corresponding semicircular limiting groove, a torsion spring is disposed in each annular groove, a first end of each torsion spring is connected to a corresponding one of the first inclined portions, and a second end of each torsion spring is connected to a corresponding one of the second inclined portions.

3. The electric suitcase according to claim 2, wherein each of the handles comprises a handle body, a handle inner tube, and a handle limiting mechanism, a handle cavity is defined in each handle body, each handle inner tube and each handle limiting mechanism are inserted into a corresponding handle cavity, each of the second inclined portions is fixed to an upper end of a corresponding handle inner tube, each of the second inclined portions covers an upper end opening of a corresponding handle cavity, each handle limiting mechanism comprises a retractable spring bolt, each retractable spring bolt passes through and is slidable in a spring bolt hole defined in a corresponding one of the second inclined portions, each of the first inclined portions comprises two locking holes, each retractable spring bolt is allowed to insert into any one of the two locking holes of a corresponding one of the first inclined portions, and the two locking holes of each of the first inclined portions are symmetrically disposed on two sides of the annular groove.

4. The electric suitcase according to claim 3, wherein each handle limiting mechanism comprises a handle limiting base, a spring bolt sliding block, and a pressing cap;

wherein each handle limiting base is fixed in a corresponding handle cavity, a limiting sliding groove is defined in each handle limiting base, each spring bolt sliding block is disposed in a corresponding limiting sliding groove, each spring bolt sliding block is slidable with respect to the corresponding limiting sliding groove, an outer side surface of each pressing cap is flush with an outer surface of a corresponding handle body, and each pressing cap is movable with respect to the corresponding handle body, wherein a wedge-shaped driving tongue is disposed on the inner side of each pressing cap, a driving tongue sleeve is disposed on one side of each handle limiting base facing a corresponding pressing cap, a wedge-shaped hole is defined in one side of each spring bolt sliding block, each wedge-shaped hole is flush with a corresponding driving tongue sleeve, each wedge-shaped driving tongue passes through a corresponding driving tongue sleeve and extends into a corresponding wedge-shaped hole, an outer inclined surface of each wedge-shaped driving tongue is in sliding fit with an inner inclined surface of a corresponding wedge-shaped hole, each retractable spring bolt is disposed on a corresponding spring bolt sliding block, a spring bolt spring is disposed in each handle cavity, each spring bolt spring is configured to drives a corresponding spring bolt sliding block and a corresponding retractable spring bolt to slide outward, and when each pressing cap is pressed, and each wedge-shaped driving tongue drives a corresponding spring bolt sliding block and a corresponding retractable spring bolt to retract into a corresponding handle cavity.

5. The electric suitcase according to claim 3, wherein a rotating shaft mounting hole is defined in a center of each of the second inclined portions, each rotating shaft passes through the corresponding rotating shaft mounting hole and extends outward, a flange is disposed on an inner end of each rotating shaft, and each flange is fixedly connected to an inner side portion of a corresponding one of the second inclined portions.

6. The electric suitcase according to claim 1, wherein an upper cover is fixed on a top portion of the steering supporting base, two push buttons are fixed within a space formed by the upper cover and the steering supporting base, and a shifting lever of each of the push buttons extends outward from the steering supporting base.

7. The electric suitcase according to claim 1, wherein the steering tube assembly comprises a steering tube base and a steering tube, the electric wheel is disposed on a lower end of the steering tube base, the steering tube is inserted into an inner side of an upper end of the steering tube base, the steering tube is configured to drive the steering tube base to synchronously rotate, and the steering supporting base is disposed on an upper end of the steering tube.

8. The electric suitcase according to claim 1, wherein each pedal limiting mechanism comprises a limiting pin fixed to a bottom portion of a corresponding one of the pedal fixing bases, a limiting hook bent inward toward a corresponding one of the pedal fixing bases is disposed on a first end of each limiting pin, a hook sliding groove is defined in a bottom portion of each pedal body, each limiting hook is slidbly disposed in a corresponding hook sliding groove, and when each pedal body slides outward from the corresponding one of the pedal fixing bases, each limiting hook hooks on a first end of the corresponding hook sliding groove.

9. The electric suitcase according to claim 8, wherein a limiting pin accommodating groove is defined in the bottom portion of each of the pedal fixing bases, each limiting pin is disposed in a corresponding limiting pin accommodating groove, a sleeving ring is disposed on a second end of each limiting pin, the first end and the second end of each limiting pin are opposite to each other, a limiting pin fixing column is disposed in each limiting pin accommodating groove, each sleeving ring is sleeved on a corresponding limiting pin fixing column, and each pedal limiting mechanism further comprises a limiting pin cover plate configured to cover on a corresponding limiting pin accommodating groove.

10. The electric suitcase according to claim 1, wherein two horizontal guide columns parallel to each other are disposed in each of the pedal fixing bases, the two horizontal guide columns of each of the pedal fixing bases are inserted into a corresponding pedal body and are slidbly connected to the corresponding pedal body, a pedal spring is sleeved on each of the horizontal guide columns, and each pedal spring is clamped between a corresponding pedal body and a corresponding one of the pedal fixing bases.

* * * * *